US007425136B2

(12) United States Patent
Wang et al.

(10) Patent No.: US 7,425,136 B2
(45) Date of Patent: Sep. 16, 2008

(54) ELECTRICAL CONNECTOR CAPABLE OF DISSIPATING HEAT GENERATED BY AN ELECTRONIC ELEMENT

(75) Inventors: Eric Wang, Taipei Hsien (TW); Ming-Chung Wang, Taipei Hsien (TW)

(73) Assignee: Advanced Connection Technology, Inc., Taipei Hsien (TW)

( * ) Notice: Subject to any disclaimer, the term of this patent is extended or adjusted under 35 U.S.C. 154(b) by 0 days.

(21) Appl. No.: 11/116,708

(22) Filed: Apr. 28, 2005

(65) Prior Publication Data

US 2007/0281506 A1 Dec. 6, 2007

(51) Int. Cl.
*H01R 12/00* (2006.01)

(52) U.S. Cl. ..... 439/70; 439/331

(58) Field of Classification Search ..... 439/70, 439/331, 73, 361, 704, 83, 71
See application file for complete search history.

(56) References Cited

U.S. PATENT DOCUMENTS

| | | | | |
|---|---|---|---|---|
| 3,960,423 | A * | 6/1976 | Weisenburger | 439/66 |
| 5,302,853 | A * | 4/1994 | Volz et al. | 257/707 |
| 5,486,771 | A * | 1/1996 | Volz et al. | 324/755 |
| 5,882,221 | A * | 3/1999 | Nguyen et al. | 439/331 |
| 6,243,267 | B1 * | 6/2001 | Chuang | 361/704 |
| 6,381,836 | B1 * | 5/2002 | Lauruhn et al. | 29/831 |
| 6,394,820 | B1 * | 5/2002 | Palaniappa et al. | 439/83 |
| 6,781,838 | B2 * | 8/2004 | Shinotou | 361/704 |
| 2003/0190831 | A1 * | 10/2003 | Hachuda | 439/331 |
| 2004/0095693 | A1 * | 5/2004 | Shirai et al. | 361/1 |

* cited by examiner

*Primary Examiner*—Tulsidas C. Patel
*Assistant Examiner*—Vladimir Imas
(74) *Attorney, Agent, or Firm*—Darby & Darby P.C.

(57) ABSTRACT

An electrical connector includes a dielectric housing having a lower base body that cooperates with an upper mounting body to confine a heat-dissipating space therebetween, and at least one opening in fluid communication with the heat-dissipating space. Conductive terminals extend through first through holes in the upper mounting body and second through holes in the lower base body, and have first contact portions that extend upwardly and outwardly of the upper mounting body to contact an electronic element mounted on the upper mounting body, and second contact portions that extend downwardly and outwardly of the lower base body. An anchoring unit is operable so as to anchor the electronic element to the upper mounting body.

14 Claims, 8 Drawing Sheets

ELECTRICAL CONNECTOR CAPABLE OF DISSIPATING HEAT GENERATED BY AN ELECTRONIC ELEMENT

BACKGROUND OF THE INVENTION

1. Field of the Invention

The invention relates to an electrical connector, more particularly to an electrical connector capable of dissipating heat generated by an electronic element.

2. Description of the Related Art

FIGS. 1 and 3 illustrate a conventional heat dissipating module that is provided on a circuit board 2 for dissipating heat produced by a CPU 21 and that includes an electrical connector 1 and a heat dissipating device 22.

The electrical connector 1 includes a rectangular lower mounting frame 11, a dielectric CPU-mounting seat 12, a set of conductive terminals 15, a rectangular upper cover frame 13, and an L-shaped engaging rod 14. The lower mounting frame 11 has opposite first and second coupling sides 110, 112. The CPU-mounting seat 12 is mounted on the lower mounting frame 11, and is mounted with the CPU 21. The CPU-mounting seat 12 has a bottom wall 121 formed with a plurality of through holes 122. Each conductive terminal 15 extends through a respective one of the through holes 122 in the bottom wall 121 of the CPU-mounting seat 12, and has an upper hook end 151 (see FIG. 2) that extends upwardly and outwardly of the corresponding through hole 122 and that contacts a corresponding one of contacts on the CPU 21 when the CPU 21 is mounted on the CPU-mounting seat 12, and a lower end 152 (see FIG. 2) that extends downwardly and outwardly of the respective through hole 122 and that contacts the circuit board 2, as shown in FIGS. 2 and 3. The upper cover frame 13 is disposed above the CPU-mounting seat 12 for covering the CPU-mounting seat 12, and has a pivot side 130 formed with a pair of pivot lugs 131 for engaging respectively a pair of pivot holes 111 formed in the first coupling side 110 of the lower mounting frame 11, and a free side 133 opposite to the pivot side 130 and formed with a tongue 132. The engaging rod 14 has a pivot rod portion 141 connected pivotally to the second coupling side 112 of the lower mounting frame 11, and an operating rod portion 143 perpendicular to the pivot rod portion 141. In use, the engaging rod 14 is rotatable on the mounting frame 11 between an anchoring position, where the tongue 132 on the free side 133 of the upper cover frame 13 is clamped between a U-shaped abutting section 142 of the pivot rod portion 141 of the engaging rod 14 and the second coupling side 112 of the lower mounting frame 11 and where the operating rod portion 143 engages an engaging lug 113 of the lower mounting frame 11, as shown in FIG. 3, and a release position, where the abutting section 142 of the pivot rod portion 141 is removed from the tongue 132 on the free side 133 of the upper cover frame 13 and where the operating rod portion 143 is removed from the engaging lug 113 on the lower mounting frame 11.

The heat dissipating device 22 is disposed on the circuit board 2 and above the upper cover frame 13, and contacts the CPU 21 via a conductive paste 210 for dissipating heat generated by the CPU 21.

In the conventional heat dissipating module, the heat generated by the CPU 21 can be conducted only through contact between the heat dissipating device 22 and the CPU 21. As such, it is hard to dissipate the heat generated by the CPU 21 and that accumulates on the conductive terminals 15, thereby resulting in an inferior heat-dissipating efficiency.

SUMMARY OF THE INVENTION

Therefore, the object of the present invention is to provide an electrical connector capable of dissipating heat from conductive terminals that are in electrical contact with an electronic element.

According to one aspect of the present invention, there is provided an electrical connector for an electronic element that has a plurality of contacts. The electrical connector comprises:

a dielectric housing having an upper mounting body adapted to be mounted with the electronic element, a lower base body cooperating with the upper mounting body so as to confine a heat-dissipating space, and at least one opening in fluid communication with the heat-dissipating space, the upper mounting body being formed with a plurality of first through holes, the lower base body being formed with a plurality of second through holes, each of which corresponds to a respective one of the first through holes in the upper mounting body;

a set of conductive terminals, each of which extends through a respective one of the first through holes in the upper mounting body and a corresponding one of the second through holes in the lower base body, and has a first contact portion extending upwardly and outwardly of the upper mounting body and adapted to contact a corresponding one of the contacts of the electronic element when the electronic element is mounted on the upper mounting body, and a second contact portion extending downwardly and outwardly of the lower base body; and an anchoring unit mounted on the dielectric housing and operable so as to anchor the electronic element to the upper mounting body of the dielectric housing when the electronic element is disposed on the upper mounting body of the dielectric housing.

According to another aspect of the present invention, there is provided a heat dissipating module adapted to be provided on a circuit board for dissipating heat produced by an electronic element that has a plurality of contacts. The heat dissipating module comprises:

an electrical connector including a dielectric housing having an upper mounting body adapted to be mounted with the electronic element, a lower base body cooperating with the upper mounting body so as to confine a heat-dissipating space, and at least one opening in fluid communication with the heat-dissipating space, the upper mounting body being formed with a plurality of first through holes, the lower base body being formed with a plurality of second through holes, each of which corresponds to a respective one of the first through holes in the upper mounting body, a set of conductive terminals, each of which extends through a respective one of the first through holes in the upper mounting body and a corresponding one of the second through holes in the lower base body, and has a first contact portion extending upwardly and outwardly of the upper mounting body and adapted to contact a corresponding one of the contacts of the electronic element when the electronic element is mounted on the upper mounting body, and a second contact portion extending downwardly and outwardly of the lower base body and adapted to contact electrically the circuit board, and an anchoring unit mounted on the dielectric housing and operable so as to anchor the electronic element to the upper mounting body of the dielectric housing when the electronic element is disposed on the upper mounting body of the dielectric housing; and a heat dissipating device adapted to be disposed on the circuit board and including a heat sink disposed above the anchoring unit and adapted to contact the electronic element when the electronic element is mounted on the upper mounting body of the dielectric housing, and a fan unit mounted on the heat sink for inducing air currents toward the heat sink and into the heat-dissipating space in the dielectric housing through the opening.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
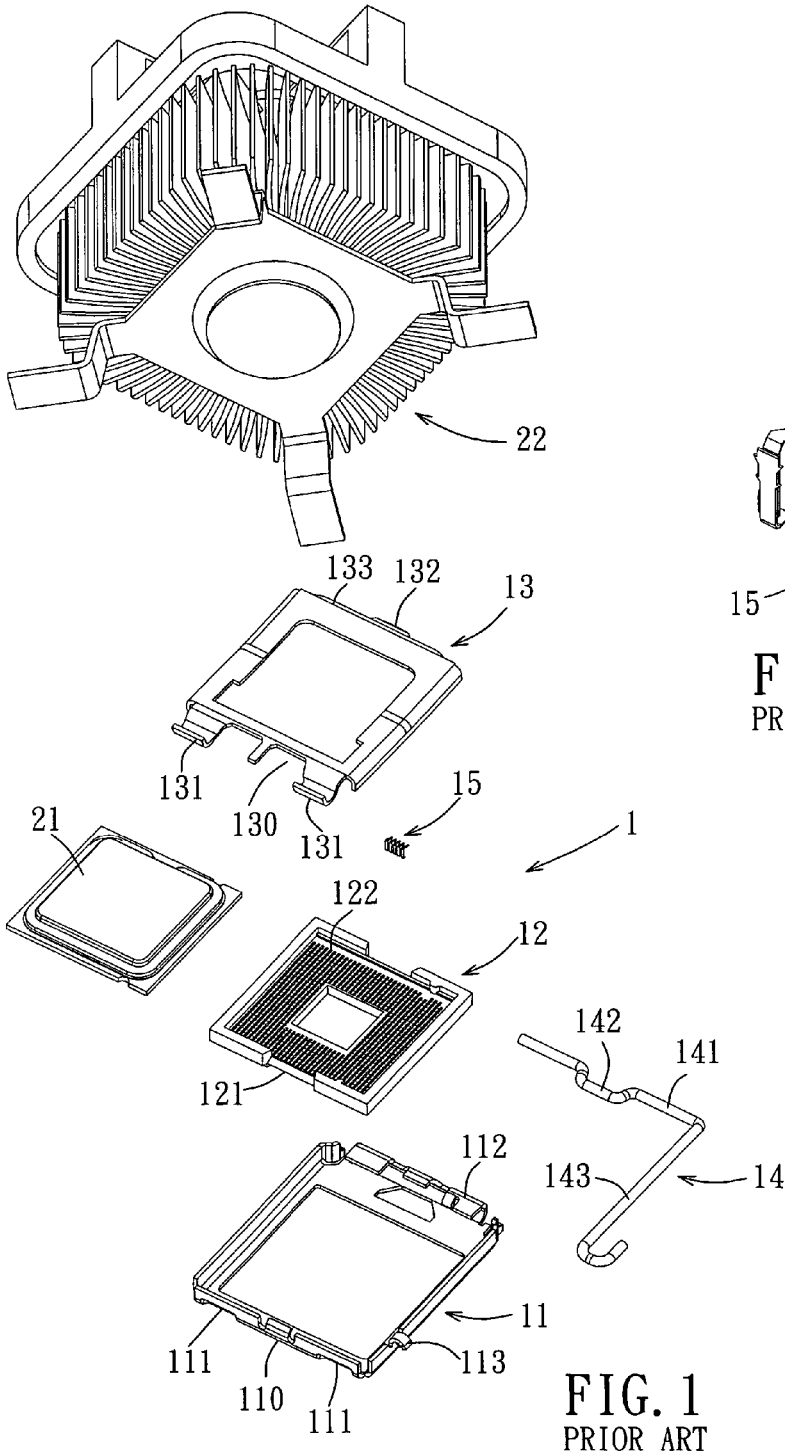
FIG. 1 PRIOR ART
FIG. 1 is an exploded perspective view of a conventional heat dissipating module.
Figure 2:
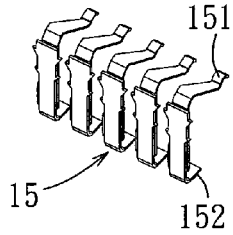
FIG. 2 PRIOR ART
FIG. 2 is a perspective view of conductive terminals of the conventional heat dissipating module.
Figure 3:
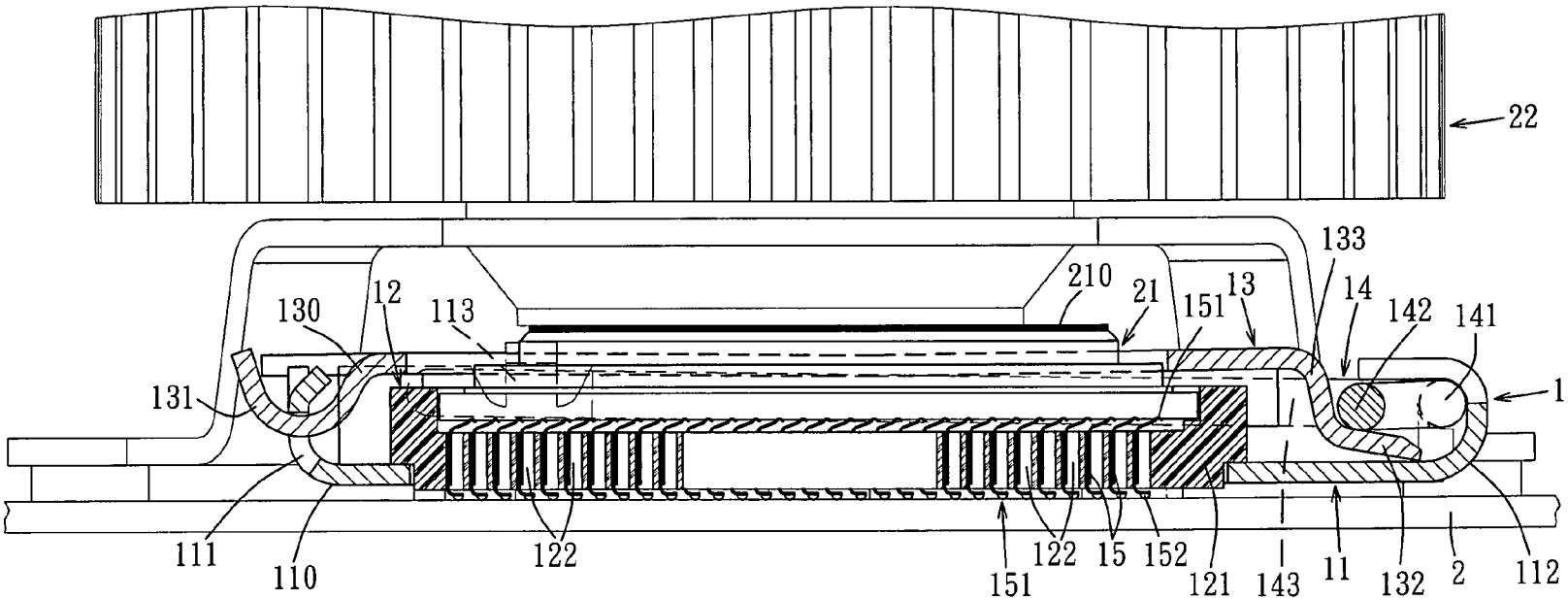
FIG. 3 PRIOR ART
FIG. 3 is a fragmentary, partly sectional, schematic view of the conventional heat dissipating module.

Before the present invention is described in greater detail, it should be noted that like elements are denoted by the same reference numerals throughout the disclosure.

Figure 4:
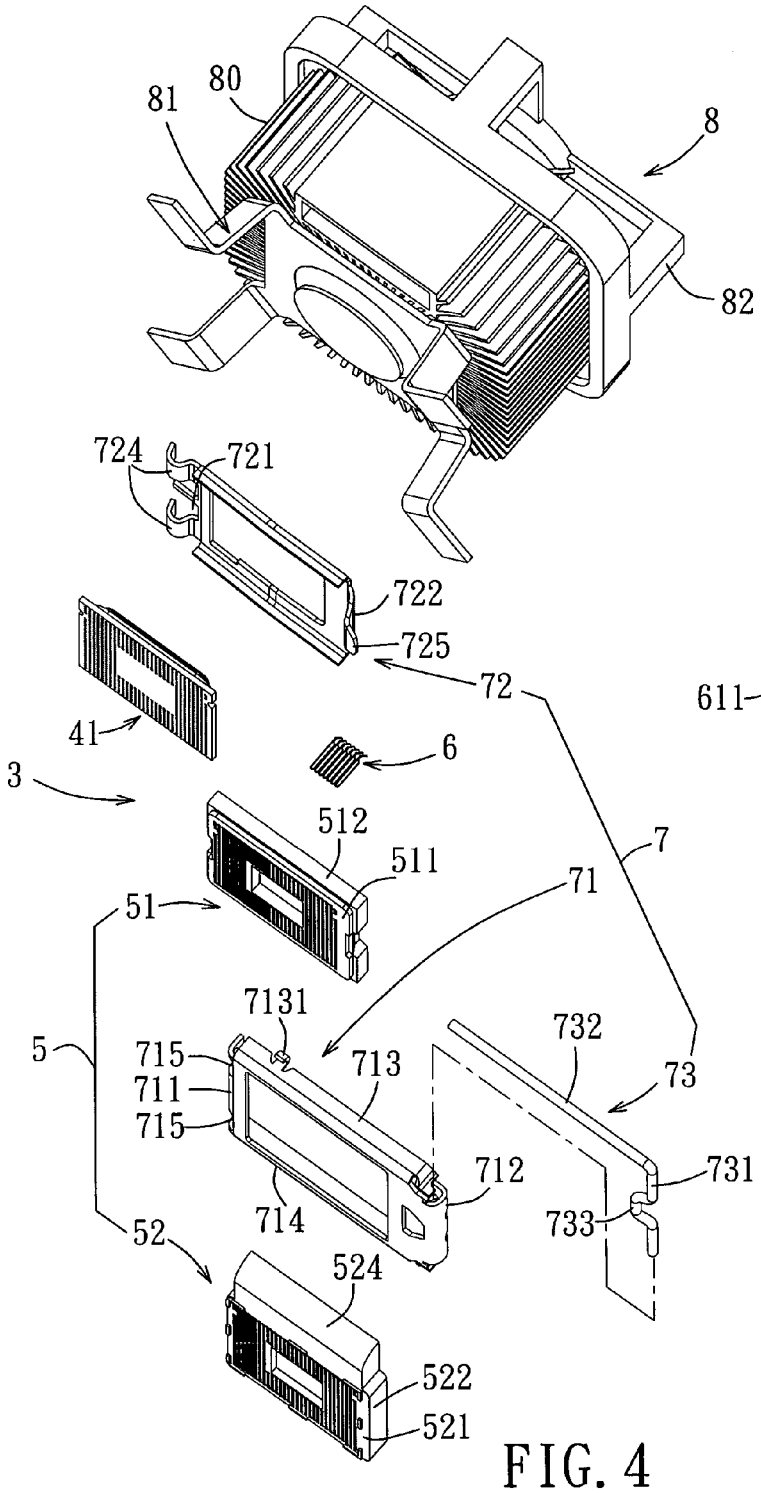
FIG. 4 is an exploded perspective view showing the first preferred embodiment of a heat dissipating module according to the present invention, in which an upper mounting body of a dielectric housing is removed from a mounting frame of an anchoring unit.
Figure 5:
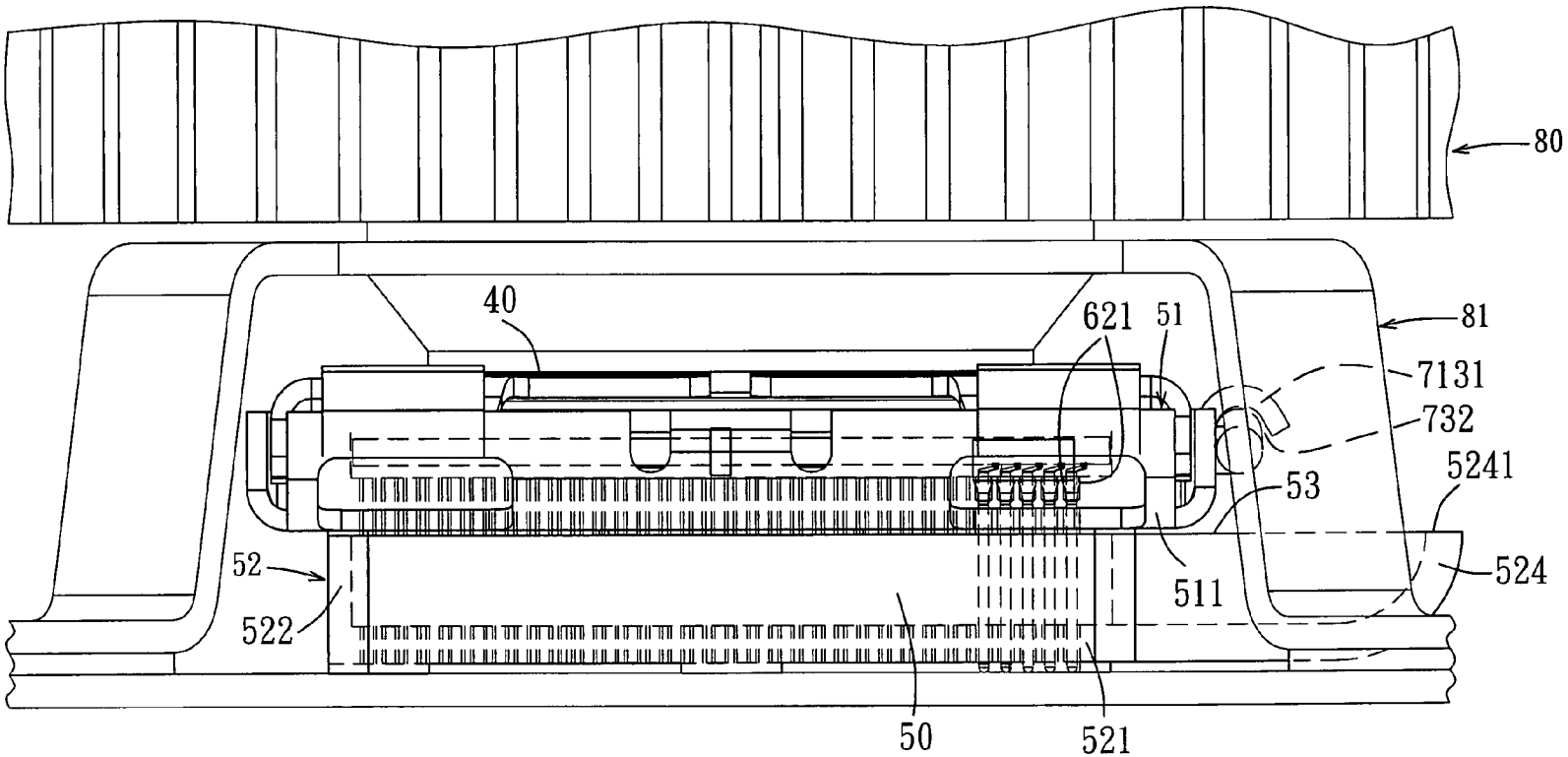
FIG. 5 is a fragmentary schematic side view showing the first preferred embodiment.
Figure 7:
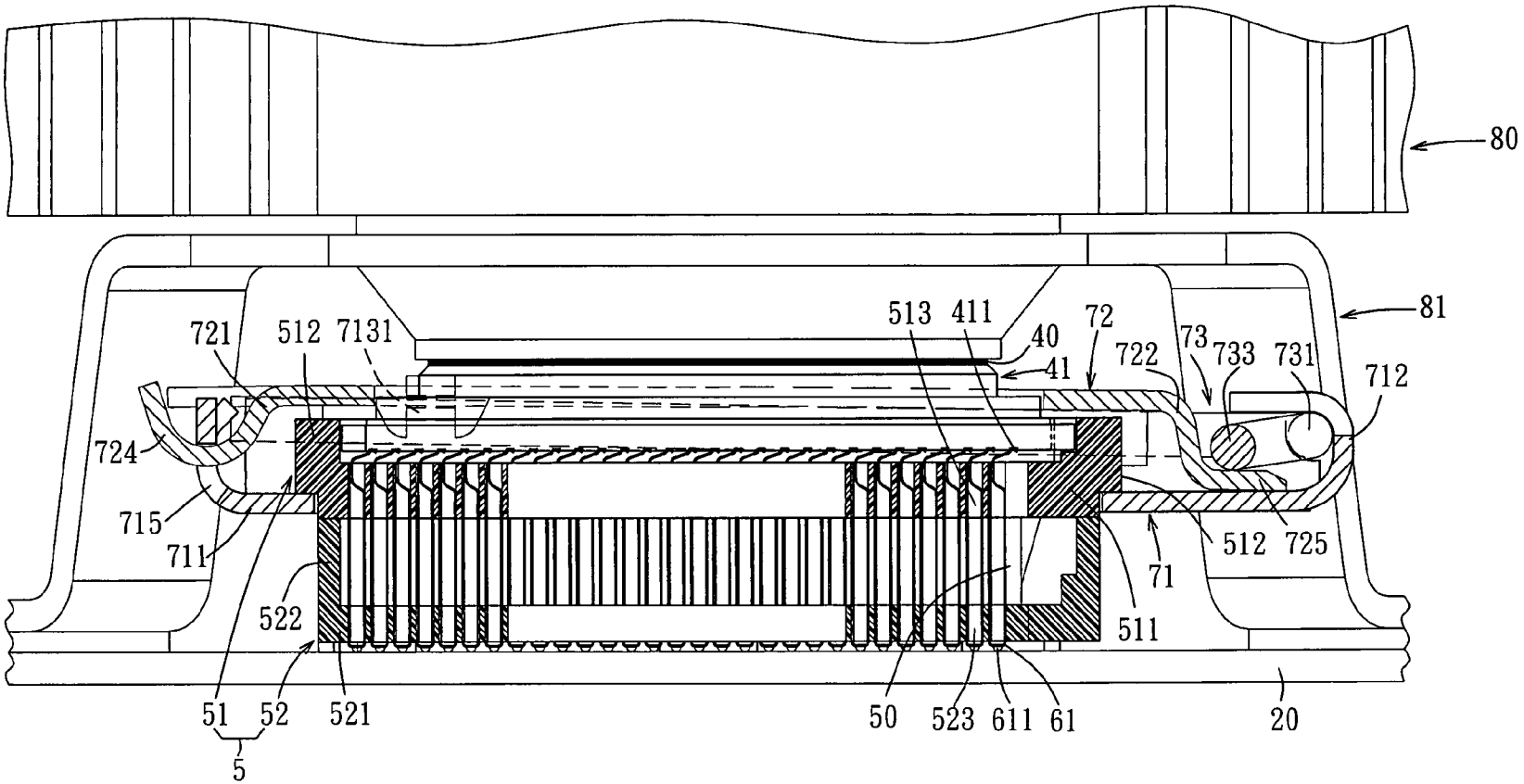
FIG. 7 is a fragmentary, partly sectional, schematic view showing the first preferred embodiment.

Referring to FIGS. 4, 5 and 7, the first preferred embodiment of a heat dissipating module according to the present invention is adapted to be provided on a circuit board 20 for dissipating heat produced by an electronic element 41, such as a CPU, and is shown to include an electrical connector 3 and a heat dissipating device 8. The electronic element 41 has a plurality of contacts 411.

The electrical connector 3 includes a dielectric housing 5, a set of conductive terminals 6, and an anchoring unit 7.

The dielectric housing 5 has an upper mounting body 51 adapted to be mounted with the electronic element 41, a lower base body 52 cooperating with the upper mounting body 51 so as to confine a heat-dissipating space 50, and an opening 53 (see FIG. 5) in fluid communication with the heat-dissipating space 50. The upper mounting body 51 has a first bottom wall 511 formed with a plurality of first through holes 513, and a first surrounding wall 512 extending upwardly from a periphery of the first bottom wall 511. The lower base body 52 has a second bottom wall 521 formed with a plurality of second through holes 523, each of which corresponds to a respective one of the first through holes 513 in the first bottom wall 521 of the upper mounting body 51, and a second surrounding wall 522 extending upwardly from a periphery of the second bottom wall 521. The heat-dissipating space 50 is confined by the first bottom wall 511 of the upper mounting body 51, and the lower base body 52. In this embodiment, the second surrounding wall 522 of the lower base body 52 is formed with a curved air guide member 524 extending outwardly and upwardly from the periphery of the second bottom wall 521 such that an upper end 5241 of the air guide member 524 and the first bottom wall 511 of the upper mounting body 51 cooperate to define the opening 53 therebetween, as shown in FIG. 5.

Figure 6:
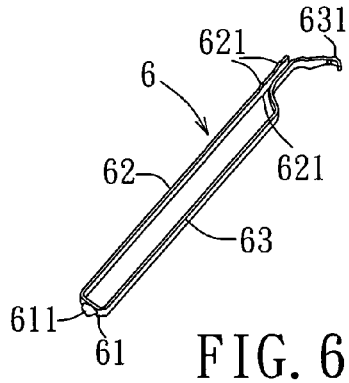
FIG. 6 is a perspective view showing a conductive terminal of the first preferred embodiment.

As shown in FIGS. 5, 6 and 7, each conductive terminal 6 extends through a respective one of the first through holes 513 in the upper mounting body 51 and a corresponding one of the second through holes 523 in the lower base body 52. In this embodiment, each conductive terminal 6 is U-shaped, and has a pair of parallel first and second elongate sections 63, 62, and an interconnecting section 61 interconnecting the first and second elongate sections 62, 63. The first elongate section 63 of each conductive terminal 6 has a hook end 631 that serves as a first contact portion, that extends upwardly and outwardly of the first bottom wall 511 of the upper mounting body 51, and that is adapted to contact a corresponding one of the contacts 411 of the electronic element 41 when the electronic element 41 is mounted on the upper mounting body 51. The interconnecting section 61 of each conductive terminal 6 serves as a second contact portion that extends downwardly and outwardly of the second bottom wall 521 of the lower base body 52 and that is formed with a solder contact 611 adapted to contact electrically the circuit board 20. In addition, the second elongate section 62 of each conductive terminal 6 is formed with a plurality of engaging teeth 621 for engaging a wall of the upper mounting body 51 of the dielectric housing 5 defining the corresponding first through hole 513, as best shown in FIG. 5.

The anchoring unit 7 is mounted on the dielectric housings, and is operable so as to anchor the electronic element 41 to the upper mounting body 51 of the dielectric housing 5 when the electronic element 41 is disposed on the upper mounting body 51 of the dielectric housing 5. In this embodiment, the anchoring unit 7 includes a rectangular mounting frame 71, a rectangular cover frame 72, a pivot unit, and an L-shaped engaging rod 73.

The mounting frame 71, which is mounted fixedly on the upper mounting body 51 of the dielectric housing 5, has opposite first and second coupling sides 711, 712, and opposite third and fourth sides 713, 714 connected between the first and second coupling sides 711, 712.

The cover frame 72 is disposed above the dielectric housing 5 for covering the upper mounting body 51. The cover frame 72 has a pivot side 721, and a free side 722 opposite to the pivot side 721.

The pivot unit is provided on the first coupling side 711 of the mounting frame 71 and the pivot side 721 of the cover frame 72 for connecting the cover frame 72 to the mounting frame 71 such that the cover frame 72 is rotatable relative to the mounting frame 71. In this embodiment, the pivot unit includes a pair of pivot holes 715 formed in the first coupling side 711 of the mounting frame 71, and a pair of pivot hooks 724 formed on the pivot side 721 of the cover frame 72 for engaging respectively the pivot holes 715, as shown in FIG. 7.

Figure 8:
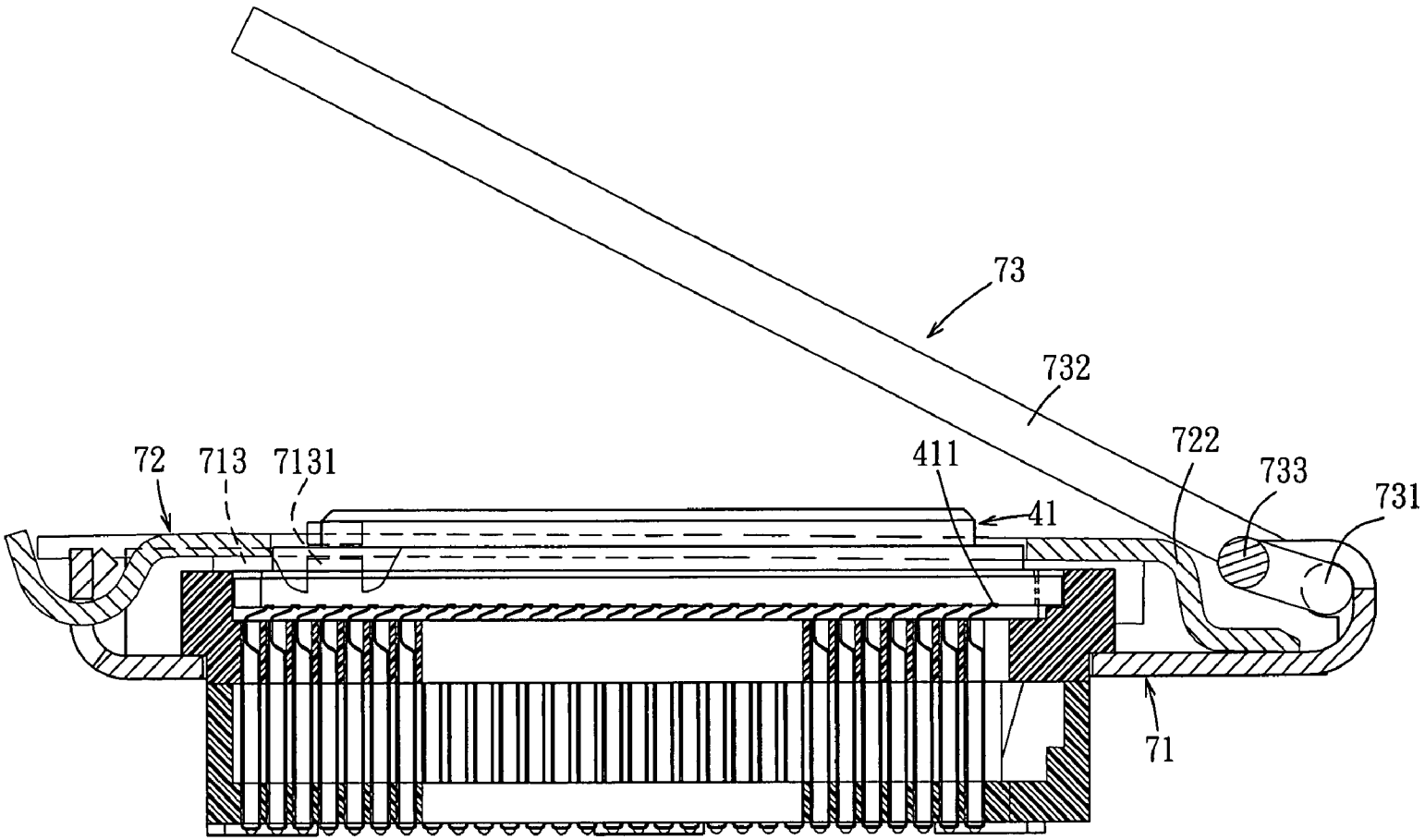
FIG. 8 is a partly sectional, schematic view illustrating an electrical connector of the first preferred embodiment when an engaging rod of the electrical connector is in a release position.

The engaging rod 73 has a pivot rod portion 731 connected pivotally to the second coupling side 712 of the mounting frame 71, and an operating rod portion 732 perpendicular to the pivot rod portion 731. The engaging rod 73 is rotatable on the mounting frame 71 between an anchoring position, where a tongue 725 formed on the free side 722 of the cover frame 72 is clamped between a U-shaped abutting section 733 of the pivot rod portion 731 of the engaging rod 73 and the second coupling side 712 of the mounting frame 71 and where the operating rod portion 732 engages an engaging lug 7131 formed on the third side 713 of the mounting frame 71, as shown in FIG. 7, and a release position, where the abutting section 733 of the pivot rod portion 731 is removed from the tongue 725 on the free side 722 of the cover frame 72 and where the operating rod portion 733 is removed from the third side 713 of the mounting frame 71, as shown in FIG. 8.

The heat dissipating device 8 is adapted to be disposed on the circuit board 20, and includes a heat sink 80, a fan unit 82 and a supporting frame 81.

The heat sink 80 is disposed above the anchoring unit 7, and is adapted to contact the electronic element 41 via a conductive paste 40 when the electronic element 41 is mounted on the upper mounting body 51 of the dielectric housing 5.

The fan unit 82 is mounted on the heat sink 80 for inducing air currents toward the heat sink 80 and into the heat-dissipating space 50 in the dielectric housing 5 through the opening 53.

The supporting frame 81 is adapted to be mounted on the circuit board 20 for supporting the heat sink 80 and the fan unit 82 thereon.

Figure 9:
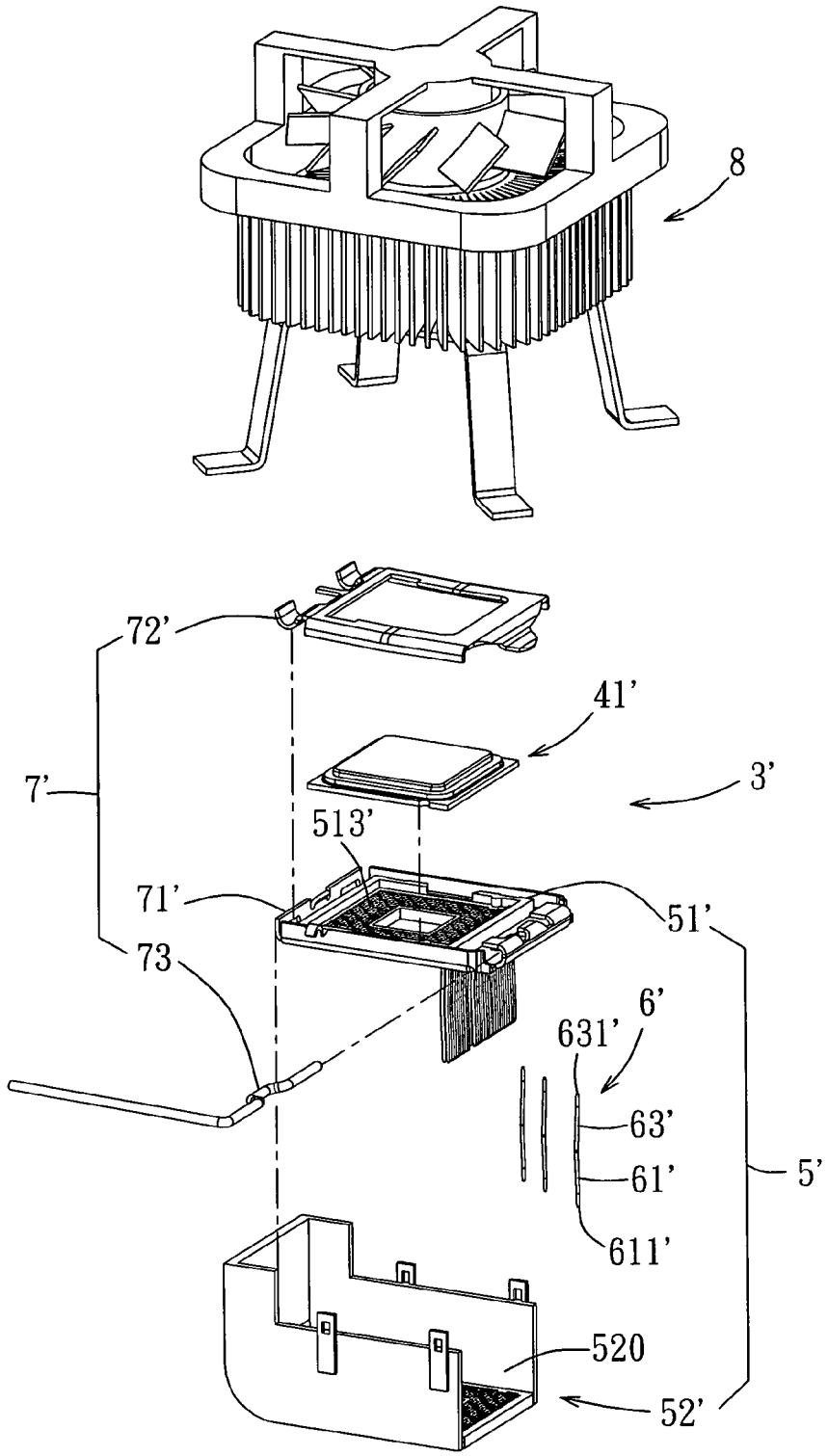
FIG. 9 is a partly exploded, perspective view showing the second preferred embodiment of a heat dissipating module according to the present invention, in which an upper mounting body of a dielectric housing is mounted within a mounting frame of an anchoring unit.
Figure 10:
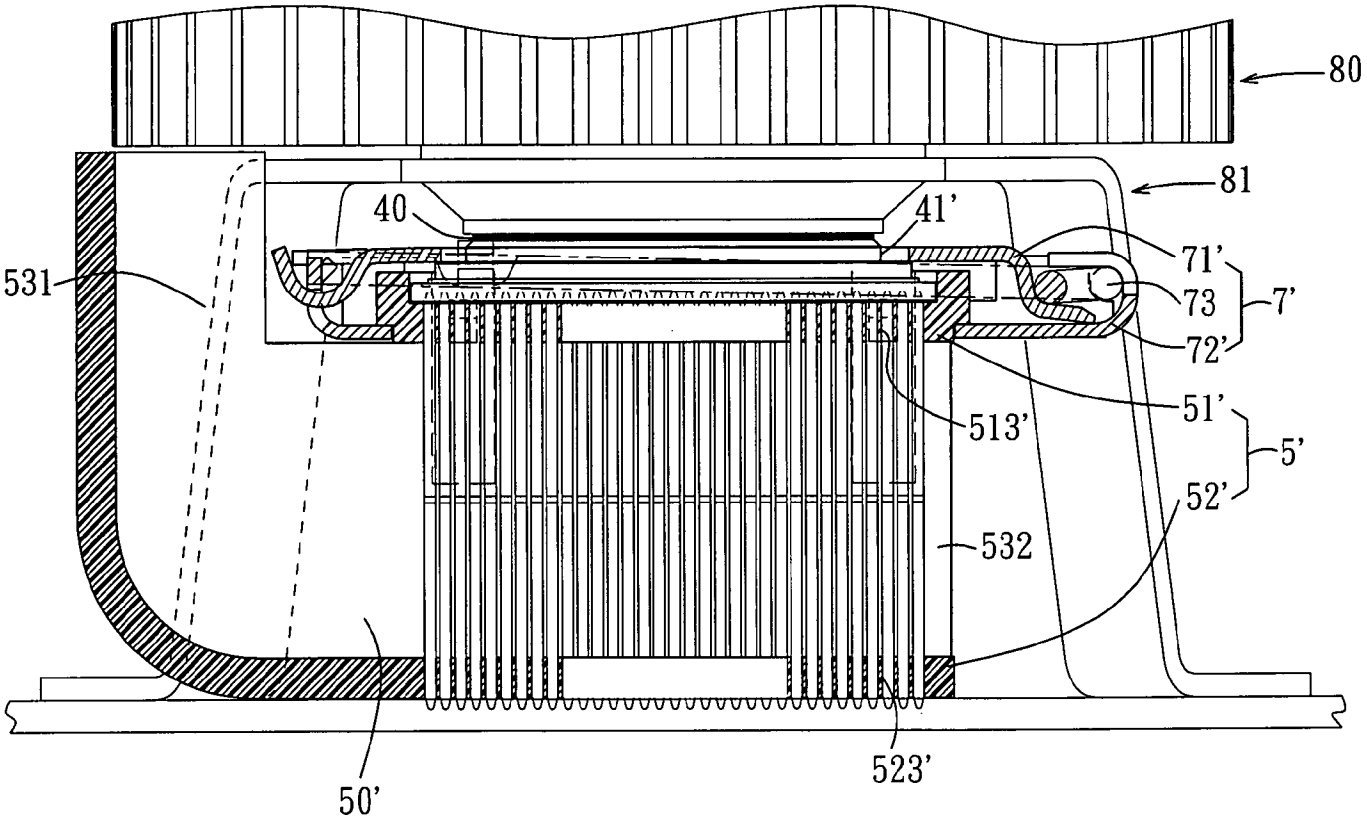
FIG. 10 is a fragmentary, partly sectional, schematic view showing the second preferred embodiment.

FIGS. 9 and 10 illustrate the second preferred embodiment of a heat dissipating module according to this invention, which is a modification of the first preferred embodiment. Unlike the previous embodiment, the dielectric housing 5' of the electrical connector 3' is formed with first and second openings 531, 532. In this embodiment, the first opening 531 has the same function as the opening 53 (see FIG. 5) in the first preferred embodiment and serves as an air inlet, whereas the second opening 532 is defined by a notch 520 in a surrounding wall 52' of the lower base body 52' and serves as an air outlet. As such, the fan unit induces air currents toward the heat sink 80 and into the heat-dissipating space 50' through the first opening 531. The air flows through the heat-dissipating space 50', and exits from the heat-dissipating space 50' through the second opening 532. Therefore, heat generated by the electronic element 41' can be dissipated effectively from the conductive terminals 6'.

In addition, each conductive terminal 6' has a resilient first section 63' formed with a first contact portion 631', and a resilient second section 61' connected to the first section 63' and formed with a second contact portion 611'. The first sections 63' of the conductive terminals 6' extend respectively through the first through holes 513' in the upper mounting body 51' of the dielectric housing 5'. The second sections 61' of the conductive terminals 6' extend respectively through the second through holes 523' in the lower base body 52' of the dielectric housing 5', as shown in FIG. 10.

To sum up, the dielectric housing 5, 5' of the electrical connector 3, 3' has the heat-dissipating space 50, 50', and preferably, the air is forced by the fan unit 82 into the heat-dissipating space 50, 50' through the opening 53, 531 so as to facilitate heat dissipation. Therefore, the heat dissipating module of this invention can provide an improved heat-dissipating effect for the electronic element 41, 41'.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. An electrical connector for an electronic element that has a plurality of contacts, said electrical connector comprising:

a dielectric housing having an upper mounting body adapted to be mounted with the electronic element, a lower base body cooperating with said upper mounting body so as to confine a heat-dissipating space, and at least one opening in fluid communication with said heat-dissipating space, said upper mounting body being formed with a plurality of first through holes, said lower base body being formed with a plurality of second through holes, each of which corresponds to a respective one of said first through holes in said upper mounting body;

a set of conductive terminals, each of which extends through a respective one of said first through holes in said upper mounting body and a corresponding one of said second through holes in said lower base body; and has a first contact portion extending upwardly and outwardly of said upper mounting body and adapted to contact a corresponding one of the contacts of the electronic element when the electronic element is mounted on said upper mounting body, and a second contact portion extending downwardly and outwardly of said lower base body; and an anchoring unit mounted on said dielectric housing and operable so as to anchor the electronic element to said upper mounting body of said dielectric housing when the electronic element is disposed on said upper mounting body of said dielectric housing;

wherein said anchoring unit includes:

a rectangular mounting frame mounted fixedly on said dielectric housing and having opposite first and second coupling sides, and opposite third and fourth sides connected between said first and second coupling sides;

a rectangular cover frame disposed above said dielectric housing for covering said upper mounting body, said cover frame having a pivot side, and a free side opposite to said pivot side;

a pivot unit provided on said first coupling side of said mounting frame and said pivot side of said cover frame for connecting said cover frame to said mounting frame such that said cover frame is rotatable relative to said mounting frame; and an L-shaped engaging rod having a pivot rod portion connected pivotally to said second coupling side of said mounting frame, and an operating rod portion perpendicular to said pivot rod portion, said engaging rod being rotatable on said mounting frame between an anchoring position, where said free side of said cover frame is clamped between said pivot rod portion of said engaging rod and said second coupling side of said mounting frame and where said operating rod portion engages one of said third and fourth sides of said mounting frame, and a release position, where said pivot rod portion is removed from said free side of said cover frame and where said operating rod portion is removed from said one of said third and fourth sides of said mounting frame.

2. The electrical connector as claimed in claim 1, wherein said pivot unit includes a pair of pivot holes formed in said first coupling side of said mounting frame, and a pair of pivot hooks formed on said pivot side of said cover frame and engaging respectively said pivot holes.

3. The electrical connector as claimed in claim 1, wherein said second contact portion of each of said conductive terminals is formed with a solder contact.

4. The electrical connector as claimed in claim 1, wherein each of said conductive terminals is U-shaped and has:

a pair of parallel first and second elongate sections, said first elongate section having a hook end that serves as said first contact portion; and an interconnecting section serving as said second contact portion and interconnecting said first and second elongate sections.

5. The electrical connector as claimed in claim 4, wherein said second elongate section of each of said conductive terminals is formed with a plurality of engaging teeth for engaging a wall of said upper mounting body of said dielectric housing defining a corresponding one of said first through holes.

6. The electrical connector as claimed in claim 1, wherein each of said conductive terminals has a first section formed with said first contact portion, and a second section connected to said first section and formed with said second contact portion, said first sections of said conductive terminals extending respectively through said first through holes in said upper mounting body of said dielectric housing, said second sections of said conductive terminals extending respectively through said second through holes in said lower base body of said dielectric housing.

7. A heat dissipating module adapted to be provided on a circuit board for dissipating heat produced by an electronic element that has a plurality of contacts, said heat dissipating module comprising:

an electrical connector including a dielectric housing having an upper mounting body adapted to be mounted with the electronic element, a lower base body cooperating with said upper mounting body so as to confine a heat-dissipating space, and at least one opening in fluid communication with said heat-dissipating space, said upper mounting body being formed with a plurality of first through holes, said lower base body being formed with a plurality of second through holes, each of which corresponds to a respective one of said first through holes in said upper mounting body, a set of conductive terminals, each of which extends through a respective one of said first through holes in said upper mounting body and a corresponding one of said second through holes in said lower base body, and has a first contact portion extending upwardly and outwardly of said upper mounting body and adapted to contact a corresponding one of the contacts of the electronic element when the electronic element is mounted on said upper mounting body, and a second contact portion extending downwardly and outwardly of said lower base body and adapted to contact electrically the circuit board, and an anchoring unit mounted on said dielectric housing and operable so as to anchor the electronic element to said upper mounting body of said dielectric housing when the electronic element is disposed on said upper mounting body of said dielectric housing;

wherein said anchoring unit includes:

a rectangular mounting frame mounted fixedly on said dielectric housing and having opposite first and second coupling sides, and opposite third and fourth sides connected between said first and second coupling sides;

a rectangular cover frame disposed above said dielectric housing for covering said upper mounting body, said cover frame having a pivot side, and a free side opposite to said pivot side;

a pivot unit provided on said first coupling side of said mounting frame and said pivot side of said cover frame for connecting said cover frame to said mounting frame such that said cover frame is rotatable relative to said mounting frame; and an L-shaped engaging rod having a pivot rod portion connected pivotally to said second coupling side of said mounting frame, and an operating rod portion perpendicular to said pivot rod portion, said engaging rod being rotatable on said mounting frame between an anchoring position, where said free side of said cover frame is clamped between said pivot rod portion of said engaging rod and said second coupling side of said mounting frame and where said operating rod portion engages one of said third and fourth sides of said mounting frame, and a release position, where said pivot rod portion is removed from said free side of said cover frame and where said operating rod portion is removed from said one of said third and fourth sides of said mounting frame; and a heat dissipating device adapted to be disposed on the circuit board and including:

a heat sink disposed above said anchoring unit and adapted to contact the electronic element when the electronic element is mounted on said upper mounting body of said dielectric housing, and a fan unit mounted on said heat sink for inducing air currents toward said heat sink and into said heat-dissipating space in said dielectric housing through said opening.

8. The heat dissipating module as claimed in claim 7, wherein said pivot unit includes a pair of pivot holes formed in said first coupling side of said mounting frame, and a pair of pivot hooks formed on said pivot side of said cover frame and engaging respectively said pivot holes.

9. The heat dissipating module as claimed in claim 7, wherein said lower base body is formed with a curved air guide member extending outwardly and upwardly therefrom, said air guide member having an upper end that cooperates with said upper mounting body to define said opening therebetween.

10. The heat dissipating module as claimed in claim 7, wherein said second contact portion of each of said conductive terminals is formed with a solder contact.

11. The heat dissipating module as claimed in claim 7, wherein each of said conductive terminals is U-shaped and has:

a pair of parallel first and second elongate sections, said first elongate section having a hook end that serves as said first contact portion; and an interconnecting section serving as said second contact portion and interconnecting said first and second elongate sections.

12. The heat dissipating module as claimed in claim 11, wherein said second elongate section of each of said conductive terminals is formed with a plurality of engaging teeth for engaging a wall of said upper mounting body of said dielectric housing defining a corresponding one of said first through holes.

13. The heat dissipating module as claimed in claim 7, wherein each of said conductive terminals has a first section formed with said first contact portion, and a second section connected to said first section and formed with said second contact portion, said first sections of said conductive terminals extending respectively through said first through holes in said upper mounting body of said dielectric housing, said second sections of said conductive terminals extending respectively through said second through holes in said lower base body of said dielectric housing.

14. The heat dissipating module as claimed in claim 7, wherein said heat dissipating device further includes a supporting frame adapted to be mounted on the circuit board for supporting said heat sink and said fan unit thereon.

* * * * *